US005476229A

United States Patent [19]

Ishikawa

[11] Patent Number: 5,476,229

[45] Date of Patent: Dec. 19, 1995

[54] ANNULAR MULTI LAYER COIL ASSEMBLY

[75] Inventor: Hiroaki Ishikawa, Nagoya, Japan

[73] Assignee: Nippondenso Co., Ltd., Kariya, Japan

[21] Appl. No.: 91,262

[22] Filed: Jul. 15, 1993

[30] Foreign Application Priority Data

Jul. 17, 1992 [JP] Japan ..... 4-191005

[51] Int. Cl.[6] ..... B65H 55/04; H01F 7/06; B21F 35/02

[52] U.S. Cl. ..... 242/174; 29/605; 72/137

[58] Field of Search ..... 242/159, 174; 29/605; 72/136, 137, 148, 206, 240

[56] References Cited

U.S. PATENT DOCUMENTS

| | | | |
|---|---|---|---|
| 3,230,111 | 1/1966 | Hall et al. | 29/605 |
| 3,348,183 | 10/1967 | Hodges et al. | 29/605 |
| 3,648,506 | 3/1972 | Caltagirone | 29/605 X |
| 4,048,713 | 9/1977 | Huass | 29/605 X |
| 4,204,417 | 5/1980 | McVoy, Jr. | 72/206 |
| 4,801,106 | 1/1989 | Kawakam et al. | 242/159 |
| 4,988,055 | 1/1991 | Sakai et al. . | |
| 5,174,013 | 12/1992 | Hiroshima et al. . | |

FOREIGN PATENT DOCUMENTS 2243468 9/1990 Japan .

*Primary Examiner*—Daniel P. Stodola
*Assistant Examiner*—Michael R. Mansen
*Attorney, Agent, or Firm*—Cushman, Darby & Cushman

[57] ABSTRACT

An annular coil assembly includes a multi layer coil having a wound-over portion in which an upper winding layer is wound over a lower winding layer, and a non-wound-over portion in which each turns of the upper winding layer is housed between two adjacent turns of the lower winding layer. The ratio of plastic deformation of the wire in the wound-over portion and adjacent areas thereof is less than that of the wire in the non-wound-over portion.

7 Claims, 7 Drawing Sheets

ANNULAR MULTI LAYER COIL ASSEMBLY

FIELD OF THE INVENTION AND RELATED ART STATEMENT

The present invention relates to an annular multi layer coil assembly and, for example, to an annular multi layer coil assembly used in a rotor of an electric rotatory machine.

In an electric rotatory machine, such as an AC generator, a starter motor or the like, it has been conventional that a wire whose cross section is circular is plastically deformed so as to present a polygonal cross section by means of at least a pair of rollers and then successively wound onto a bobbin in order to increase a winding density of a annular multi layer coil of the rotor. This is disclosed in, for example, U.S. Pat. Nos. 4,988,055 and 5,174,013.

A wire of the coil is formed by baking and coating a surface of a conductor with an insulating coating of polyester or the like. The wire is plastically deformed so as to convert a circular cross section into a polygonal one, with the result that a thickness of the insulating coating in a corner of the polygonal cross section is less than that of a side of the polygonal cross section.

For this reason, the thickness of the insulating coating in a wound-over portion in which an upper-winding layer is wound over a lower-winding layer is less than that in a non-wound-over portion in which a turn of the upper-winding layer is housed between adjacent turns of the lower-winding layer.

Therefore, the wire withstand voltage of the coil depends on the thickness of the insulating coating in the corner portion of the turn in the winding layer. When the degree of plastic deformation is large (the coating becomes thin), the wire withstand voltage of the coil cannot reach a required level. As a result, an insulating coating having excellent resistance against the winding processing must be used to maintain a dielectric strength, thereby increasing costs.

OBJECT AND SUMMARY OF THE INVENTION

Accordingly, it is an object of the present invention to provide an annular multi,layer coil assembly which is capable of obtaining a required wire withstand voltage without increasing costs.

The above and further objects and novel features of the invention will be more apparent from the following description of the embodiments described in connection with the accompanying drawings.

DETAILED DESCRIPTION OF THE PREFERRED EMBODIMENTS

Figure 3:
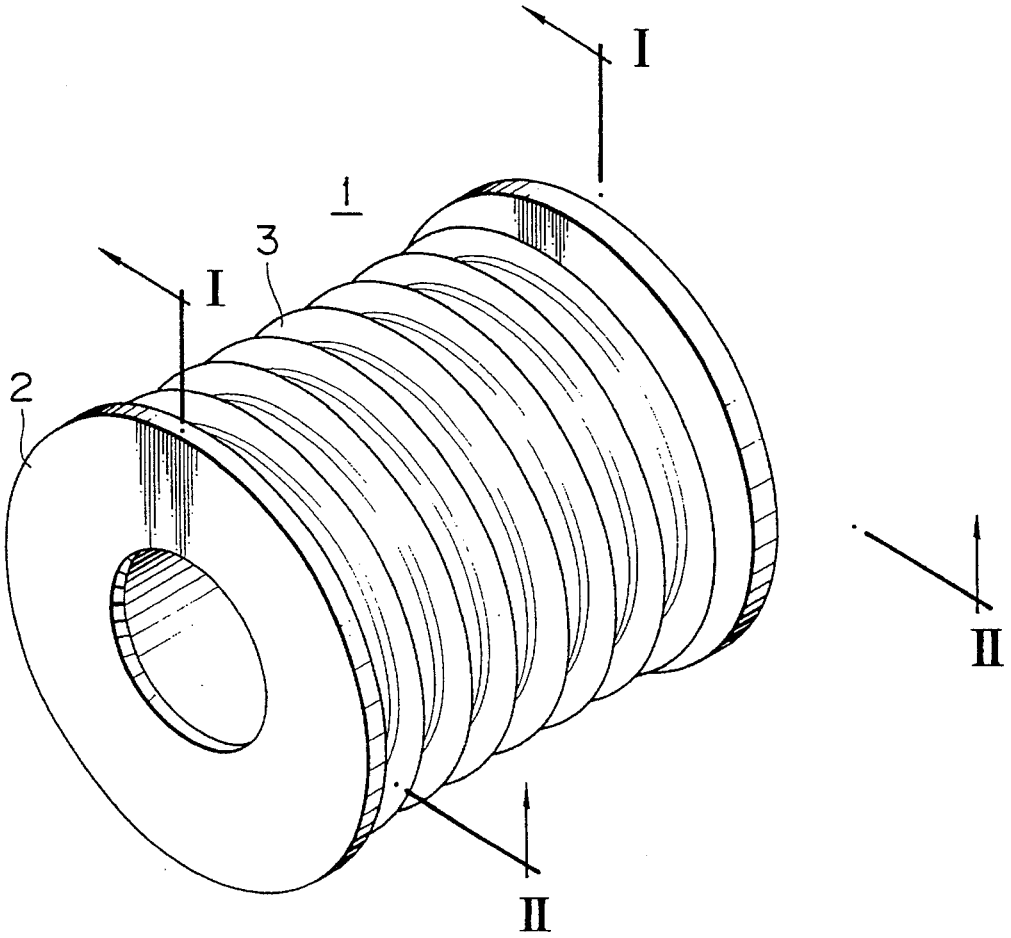
FIG. 3 is a perspective view of the annular multi layer coil assembly in accordance with the first embodiment of the present invention.

An annular multi layer coil assembly 1 according to the first embodiment is used as a rotor coil for an AC generator or a starter motor for a vehicle. As shown in FIG. 3, the annular coil assembly 1 comprises an insulating bobbin 2 having an approximately cylindrical shape and a multi layer coil into which a wire 3 is wound successively on a surface of the cylindrical bobbin 2.

Figure 1:
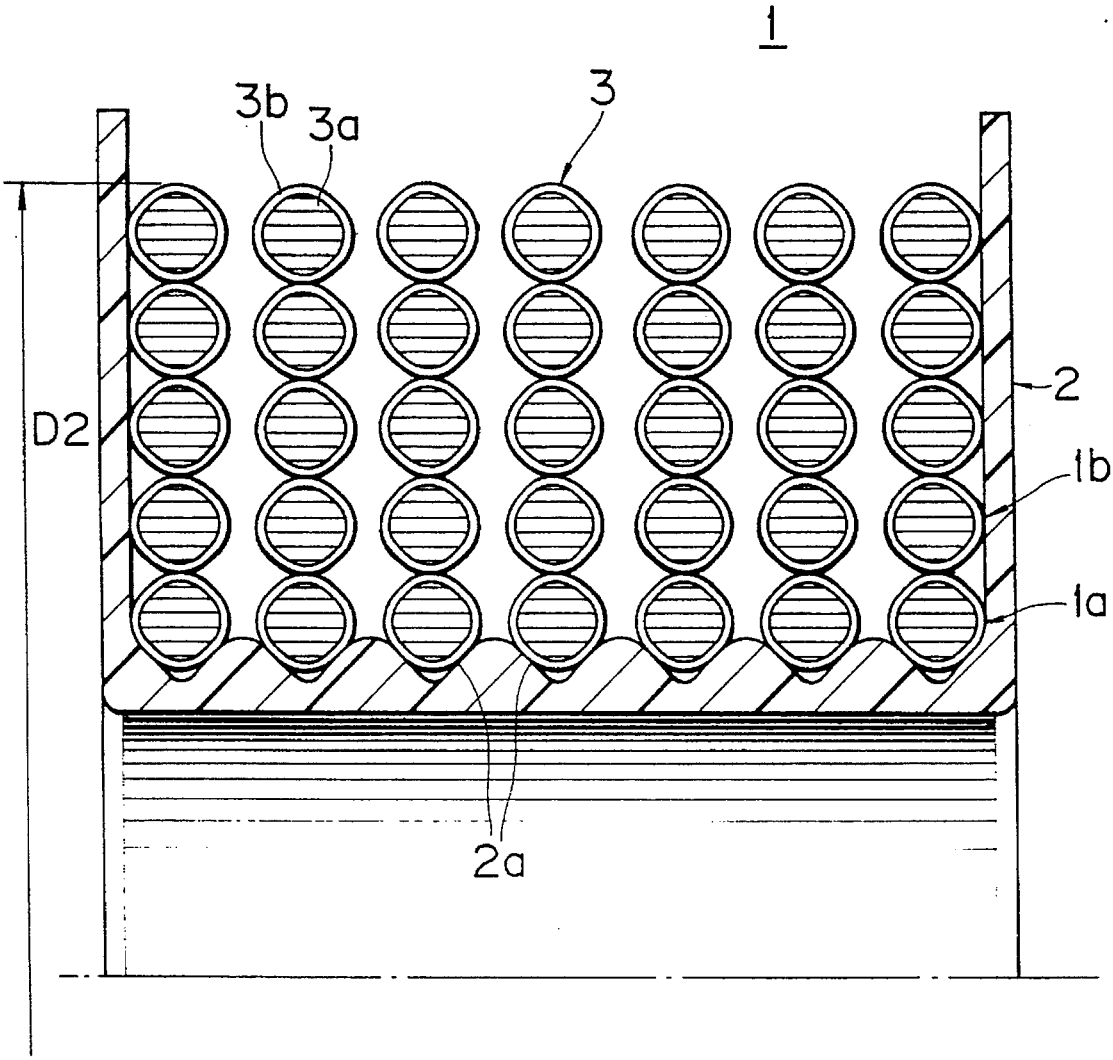
FIG. 1 is a sectional view illustrating a wound-over portion of an annular multi layer coil assembly, taken along the lines I—I of FIG. 3.
Figure 2:
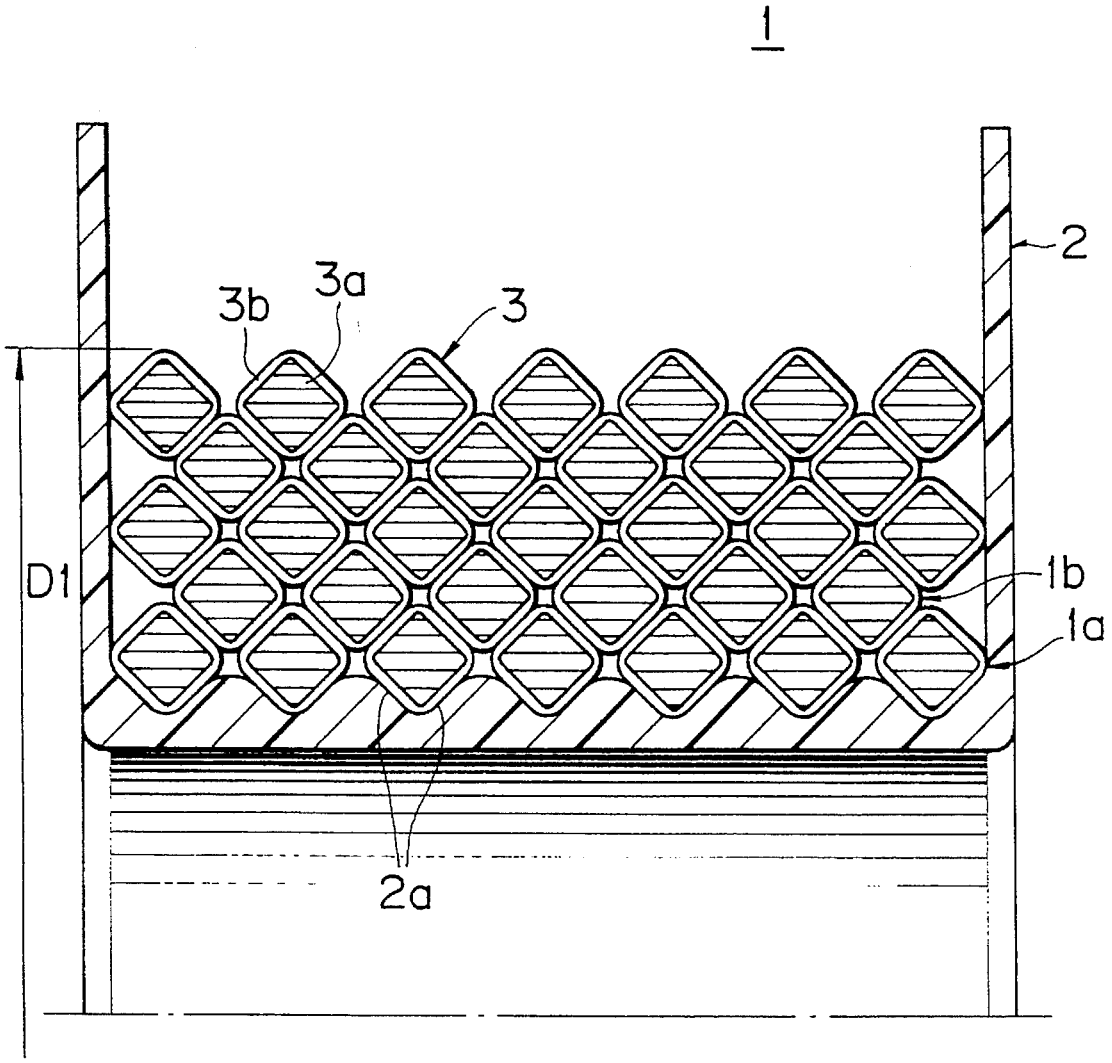
FIG. 2 is a sectional view illustrating a non-wound-over portion of the coil assembly, taken along the lines II—II of FIG. 3.

The bobbin 2 is produced by molding a thermoplastic resin, such as nylon. As shown in FIGS. 1 and 2, a guide 2*a* for guiding the wire 3 is provided on an outer peripheral surface of the bobbin 2, around which the wire 3 is wound. The guide 2*a* is formed into a thread shape in which a root portion and a thread portion axially alternate each other, each of which is flared at 90°. Each of guide surfaces is inclined at 45° with respect to an axis of the bobbin 2.

The wire 3 is produced by baking and coating an insulating coating 3*b* of polyester or the like on a surface of a conductor 3*a* of copper or the like. The wire 3 initially has a circular cross section, and is plastically deformed by rollers so as to present an approximately square cross section immediately before the winding operation.

The multi layer coil is so formed that a wire 3 is wound on the guide 2*a* of the bobbin 2 by predetermined turns into a lowermost winding layer 1*a*. Sequentially the wire 3 is further wound on an uneven surface defined by the layer 1*a* as a guide surface into an upper winding layer 1*b*. In this way, the wire 3 is wound into a multi layer coil.

Accordingly, in order to form an upper winding layer, a wire portion of the wire 3 to be wound into the upper winding layer is once wound over the lower winding layer, and is guided by the uneven surface defined by the lower winding layer and wound into the upper winding layer. Therefore, the multi layer coil comprises a wound-over portion (see FIG. 1) in which the upper winding layer 1*b* is wound over the lower winding layer 1*a*, and the remainder or a non-wound-over portion (see FIG. 2) in which each turn of the upper winding layer 1*b* is housed by adjacent two turns of the lower winding layer 1*a*.

Since the guide surface of the guide 2*a* of the bobbin 2 is inclined at 45° with respect to the axis of the bobbin 2, the wire 3 is so disposed that one of diagonals of the wire 3 of a square cross section extends in a direction perpendicular to the axis of the bobbin 2, i.e., in a radial direction, and the other diagonal of the wire is in parallel to the axis of the bobbin 2.

Figure 4:
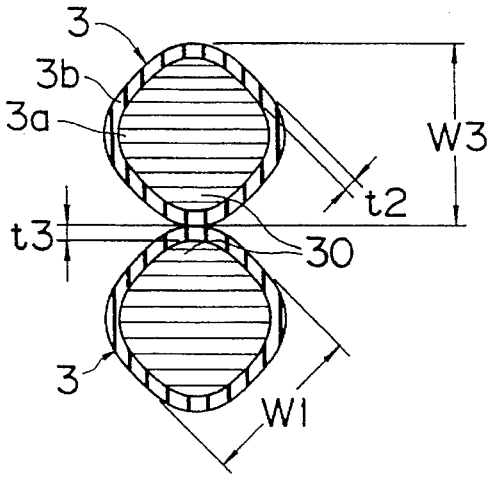
FIG. 4 is an enlarged sectional view of the wound-over portion shown in FIG. 1.

Therefore, the corner portions 30 of the lower winding layer abut against the corner portions 30 of the upper winding layer in the wound-over portion (FIG. 4). In the non-wound-over portion, the sides 31 of the lower winding layer abut against the sides 31 of the upper winding layer (see FIG. 5).

Figure 5:
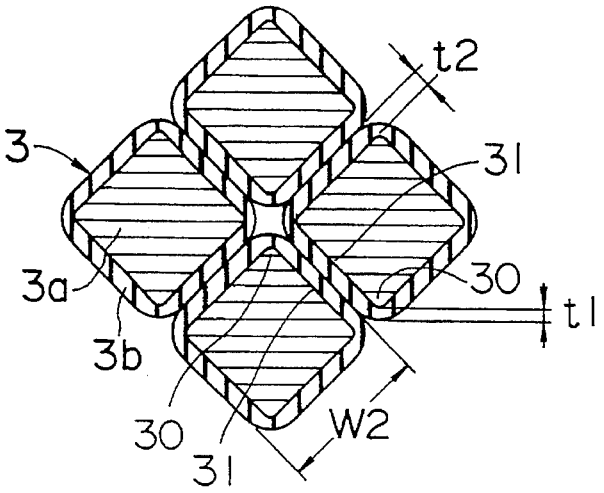
FIG. 5 is an enlarged sectional view of the non-wound-over portion shown in FIG. 2.

In this embodiment, a ratio of plastic deformation of the wire 3 in the wound-over portion of the coil and in the adjacent portions thereof is smaller than that in the remainder or the non-wound-over portion. More specifically, a distance W1 between opposite sides of the wire 3 in the wound-over portion (FIG. 4) is set larger than a distance W2 between opposite sides of the wire 3 in the non-wound-over portion (FIG. 5). Namely the wire 3 is so plastically deformed that a curvature radius of the corner portions 30 of the wire 3 in the wound-over portion is made relatively larger.

Therefore, a degree of the decrease of a thickness t3 of the insulating coating 3*b* of the corner portion 30 in the wound-over portion and in the adjacent portions thereof is smaller than that of a thickness t1 of the insulating coating 3*b* of the corner portions 30 of the coil 3 in the non-wound-over portion. In other words, the thickness t3 of the insulating coating 3*b* in the wound-over portion can be made greater than the thickness t1 of the insulating coating 3*b* in the non-wound-over portion.

As a result, a sufficient wire withstand voltage of the coil can be obtained without using the insulating coating having excellent resistance against the winding processing since the thickness t3 of the insulating coating 3*b* in the wound-over portion is greater than that in the conventional case.

Figure 10:
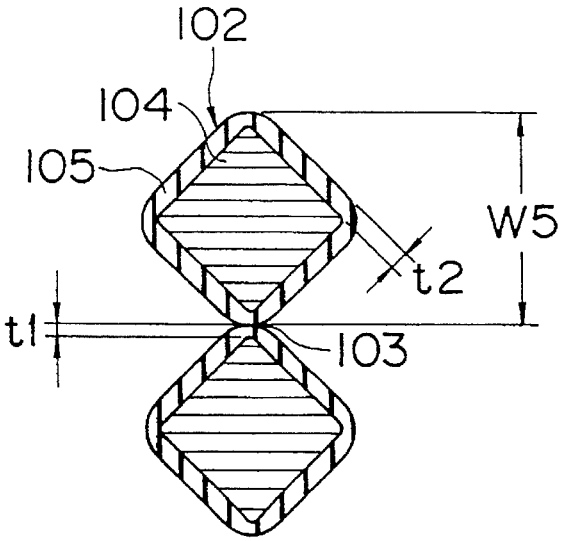
FIG. 10 (PRIOR ART)
FIG. 10 is an enlarged sectional view of the wound-over portion of FIG. 8.
Figure 8:
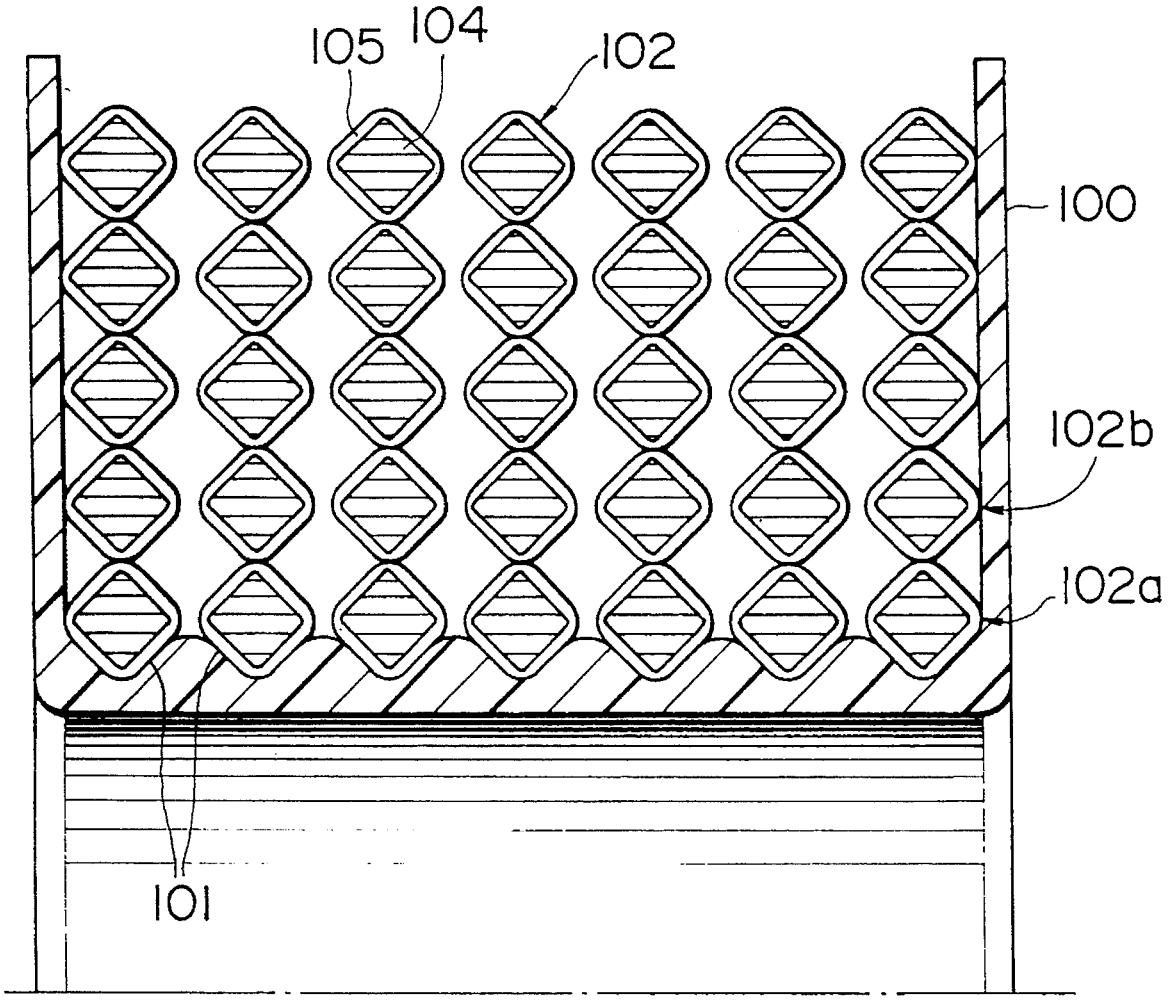
FIG. 8 (PRIOR ART)
FIG. 8 is a sectional view illustrating a wound-over portion of an annular coil assembly of the related art.
Figure 9:
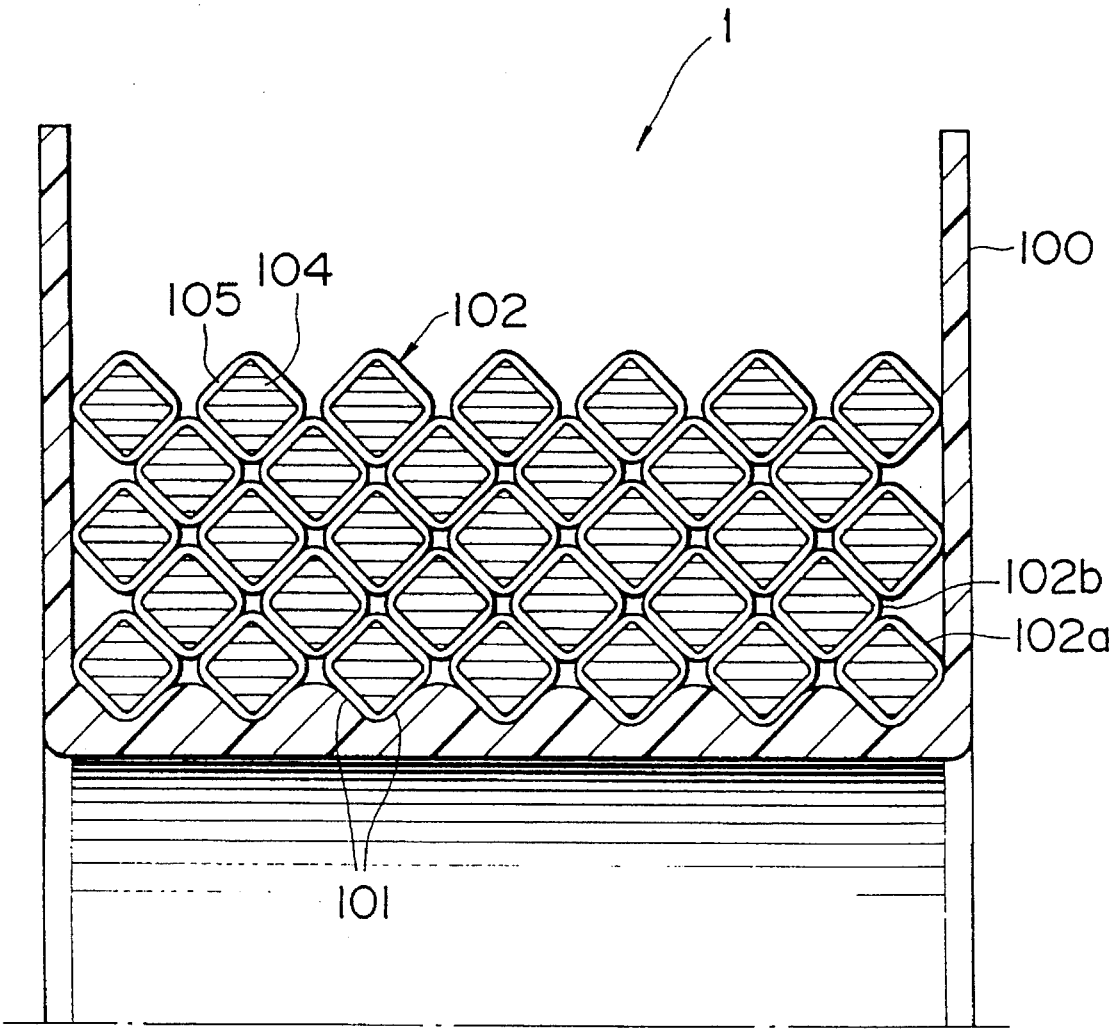
FIG. 9 (PRIOR ART)
FIG. 9 is a sectional view illustrating a non-wound-over portion of the annular coil assembly of the related art.

In a conventional coil assembly, a wire 102 is produced by baking and coating an insulating coating 105 of polyester or the like on a surface of a conductor 104 of copper or the like. The wire 102 initially has a circular cross section, and is plastically deformed by rollers so as to present an approximately square cross section uniformly over the entire length thereof. Therefore, in comparison to the thickness of the insulating coating 105 in a wound-over portion (see FIG. 8) in which an upper winding layer 102*b* is wound over a lower winding layer 102*a* and the corner portions of the turns of the layer 102*a* abut against the corner portions of the turns of the layer 102*b* (FIG. 10), and in a non-wound-over portion (FIG. 9) in which each turn of the upper winding layer 102*b* is housed between adjacent two turns of the lower winding layer 102*a* and the sides of the turns of the layer 102*a* abut against the sides of the turns of the layer 102*b*, the thickness of an insulating coating 105 in the wound-over portion is less than that in the non-wound-over portion.

Therefore, as the wire withstand voltage of the wire 102 depends on the thickness t1 of the insulating coating 105 in the corner portions of the turn, the wire withstand voltage becomes small.

Since an outer diameter D2 of the annular coil assembly 1 in the wound-over portion is larger than an outer diameter D1 in the non-wound-over portion, the maximum outer diameter of the coil assembly 1 is represented by the outer diameter D2. In this embodiment, the ratio of plastic deformation of the wire 3 in the wound-over portion is made smaller than that of the wire 3 in the non-wound-over portion, a length W3 of one diagonal of the wire 3 in the wound-over portion 4, e.g., a radial length, is smaller than a length W5 of the diagonal in the wound-over portion of the prior art.

As a result, the maximum outer diameter of the annular coil assembly 1 represented by the outer diameter D2 can be made smaller. Therefore, according to this embodiment, it is possible to wind the coil at a higher density as compared with the conventional one on the assumption that the maximum outer diameters are the same with each other.

Figure 6:
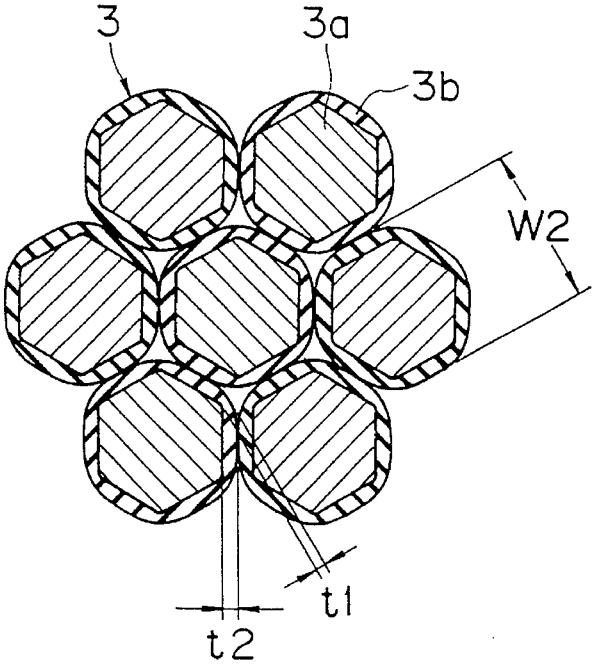
FIG. 6 is an enlarged sectional view illustrating a non-wound-over portion of the coil assembly in accordance with a second embodiment of the present invention.

The wire 3 whose cross section is circular may be plastically deformed into an approximately regular hexagonal shape or other polygonal shapes, as shown in FIG. 6. Even in this case a ratio of plastic deformation of the wire 3 in the wound-over portion of the coil and in the adjacent portions thereof is smaller than that in the remainder or the non-wound-over portion.

Figure 7:
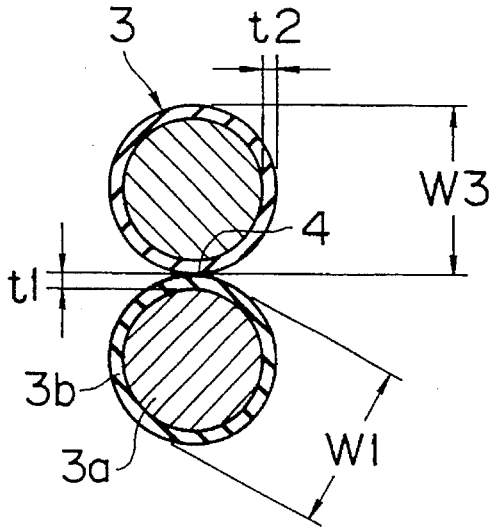
FIG. 7 is an enlarged sectional view illustrating a wound-over portion of the coil assembly in accordance with the second embodiment of the present invention.

In addition, it is possible to eliminate a plastic deformation in the wound-over portion and adjacent portions, namely a ratio of plastic deformation is zero, so that the cross section of the wire 3 in the wound-over portion is remained in a circular shape as shown in FIG. 7.

What is claimed is:

1. An annular coil assembly comprising:

a tubular bobbin; and a multi-layer coil of a wire having a conductor and an insulating coating provided on a periphery of said conductor, which wire is wound around said bobbin to form plurality of winding layers each comprising a plurality of turns of said wire, said coil including:

a wound-over portion in which said turns of said wire of an upper winding layer are wound over respective turns of an underlying winding layer and have a first cross section, and a non-wound-over portion in which each turn of an upper winding layer is disposed between adjacent two turns of an underlying winding layer and have a second polygonal cross section, wherein a minimum thickness of said insulation coating in said wound-over portion is greater than a minimum thickness of said insulation coating in said non-wound-over portion.

2. An annular coil assembly according to claim 1, wherein said second polygonal cross section in the non-wound-over portion is a square.

3. An annular coil assembly according to claim 2, wherein said first cross section in the wound-over portion is a circle.

4. An annular coil assembly according to claim 1, wherein said second polygonal cross section in the non-wound-over portion is a hexagon.

5. An annular coil assembly according to claim 4, wherein said first cross section in the wound-over portion is a circle.

6. An annular coil assembly according to claim 1, wherein said first cross section in the wound-over portion is a circle.

7. An annular coil assembly comprising:

a tubular bobbin; and a multi-layer coil of a wire having a conductor and an insulating coating provided on a periphery of said conductor, wherein said wire has a polygonal cross section and is wound around said bobbin to form a plurality of winding layers each comprising a plurality of turns of said wire, said plurality of winding layers including:

a lower winding layer having an uneven surface thereof defined by said turns of said wire, and an upper winding layer formed over said lower winding layer forming a wound-over portion and a non-wound-over portion, wherein, in said wound-over portion of said coil where said turns of said upper winding layer are wound over respective turns of said lower winding layer and have a first cross section, a minimum thickness of, said insulating coating around said conductor is more than a minimum thickness of said insulating coating in non-wound-over portion of said coil, where respective turns of said upper winding layer are disposed in conformance with said uneven surface of said lower winding layer and have a second polygonal cross section.

* * * * *